US006705240B2

(12) United States Patent
Block et al.

(10) Patent No.: US 6,705,240 B2
(45) Date of Patent: Mar. 16, 2004

(54) PORTABLE TABLE FOR OUTDOOR USE

(76) Inventors: Robert H. Block, 1622 N. Mohawk St., Apt. A, Chicago, IL (US) 60614; Miguel Ruiz, 1414 Birchwood St., Delavan, WI (US) 53115

( * ) Notice: Subject to any disclaimer, the term of this patent is extended or adjusted under 35 U.S.C. 154(b) by 0 days.

(21) Appl. No.: 10/118,422

(22) Filed: Apr. 8, 2002

(65) Prior Publication Data

US 2003/0188673 A1 Oct. 9, 2003

(51) Int. Cl.[7] ..... A47B 85/00
(52) U.S. Cl. ..... 108/150; 108/25
(58) Field of Search ..... 108/150, 25, 26, 108/44, 43; 248/533, 532, 530

(56) References Cited

U.S. PATENT DOCUMENTS 2,720,249 A * 10/1955 Peterson
2,805,109 A * 9/1957 Kopmar
2,877,828 A * 3/1959 Barnette, Jr.
3,283,733 A * 11/1966 Boerma
4,920,897 A * 5/1990 Reed et al.
5,161,561 A * 11/1992 Jamieson
5,647,075 A * 7/1997 Perkins
6,467,843 B1 * 10/2002 Rossborough
6,487,977 B1 * 12/2002 Williams et al.

FOREIGN PATENT DOCUMENTS

EP 461470 A1 * 12/1991

* cited by examiner

*Primary Examiner*—Jose V. Chen
(74) *Attorney, Agent, or Firm*—Timothy J. Keefer; Wildman, Harrold, Allen & Dixon LLP

(57) ABSTRACT

The disclosure relates to a portable table that can be anchored to an earthen surface. The portable table has a top portion comprising opposing surfaces, and at least one stand member. The stand member may be secured to the top portion by a securing member in a disassembled state to facilitate transportation of the portable table. In addition, the top portion may include an opening capable of receiving and holding drinking containers

17 Claims, 1 Drawing Sheet

FIG. 1
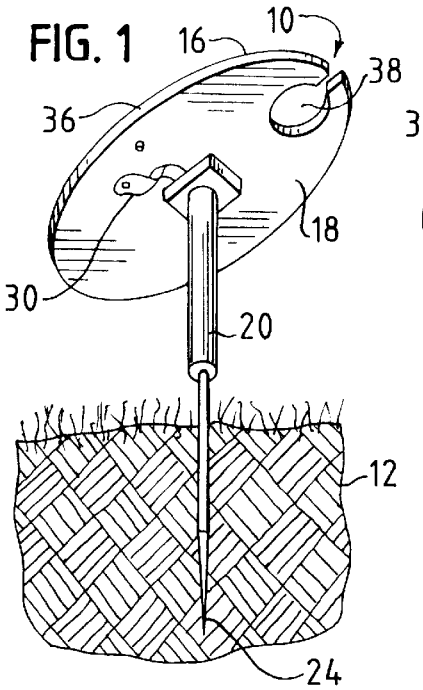
FIG. 2
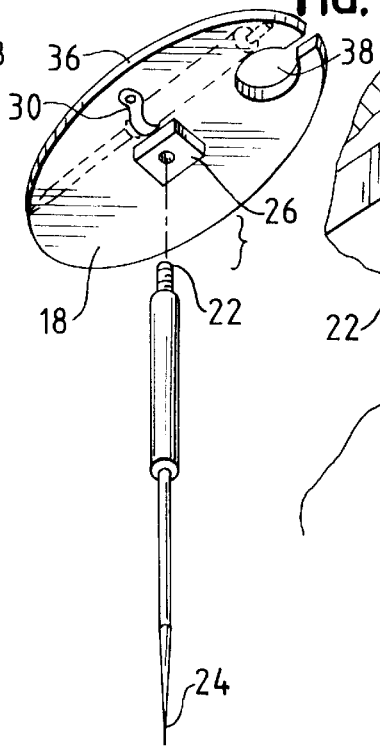
FIG. 3
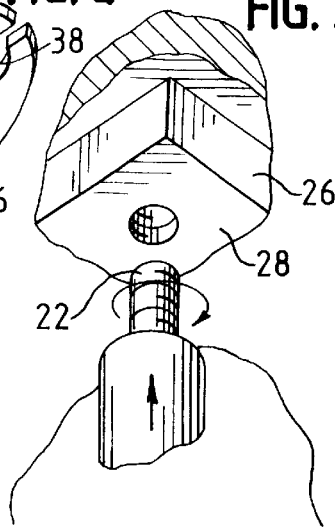
FIG. 4
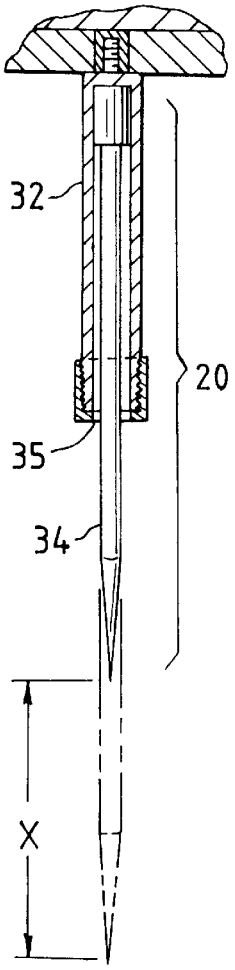
FIG. 5
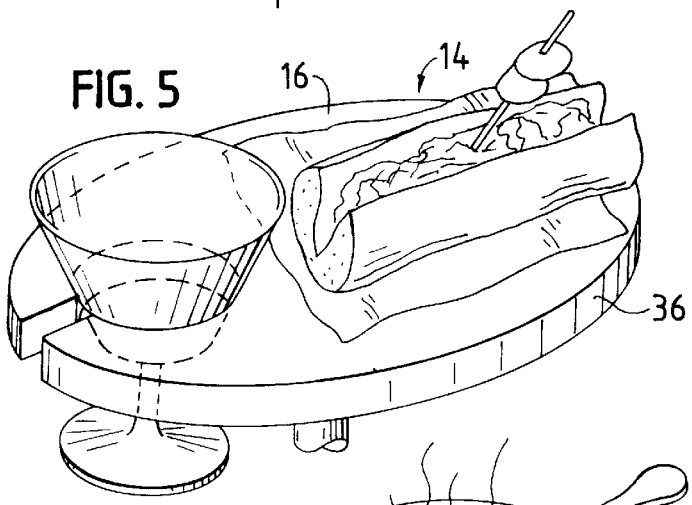
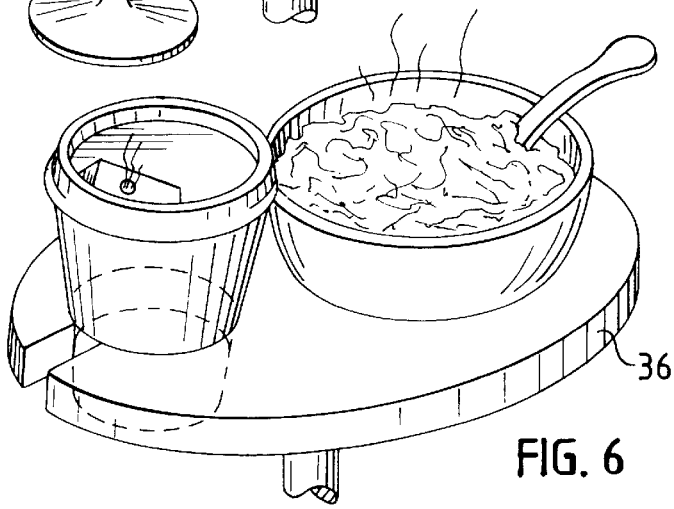
FIG. 6

PORTABLE TABLE FOR OUTDOOR USE

FIELD OF THE INVENTION

This invention relates generally to portable tables, and more specifically to a portable table that can be anchored to a surface.

BACKGROUND OF THE INVENTION

Portable tables are well known in the art. They are generally smaller in size than conventional tables or collapsible, so as to facilitate transportation and storage. These include card tables, tailgate party tables, convertible table/benches, collapsible picnic tables, etc. Many people employ portable tables when they are outside. These tables are often used to keep food, beverages, personal belongings, etc.

Portable tables heretofore devised and utilized are known to consist of many materials and configurations. U.S. Pat. Nos. 4,249,773, 5,14,441 and 5,367,964 are examples of different configurations of portable tables. However, these portable tables often fail to meet the needs of outdoor enthusiasts because they are too large to be transported easily, are hard to store, are made of many parts, can be easily lost, or are too unstable to be placed on uneven ground.

U.S. Pat. No. 4,852,835 (Ciulli et al) describes a table having a single supporting leg to be anchored to the ground and a tiltable top panel. Because of its wide ring feature, it is believed that the table might be hard to store. Additionally, the tilting nature of the top panel might make it susceptible to spillage of contents. U.S. Pat. No. 5,762,004 (Vashon et al.) describes a portable table that can be anchored into the ground. However, the disclosed table is difficult to assemble due to its high number of removable parts.

Given the cumbersome size, weight and configurations of known portable tables, a small, easily transportable, easily stored, table comprised of small number of parts, and capable of being anchored into an earthen surface so as to provide added stability would be an improvement over the art as such a table would provide increased enjoyment for outdoor enthusiasts.

OBJECTS OF THE INVENTION

An object of this invention is to provide a new portable outdoor table that overcomes some of the problems and shortcomings of the prior art.

Another object of the invention is to provide a new portable outdoor table that can be anchored to a surface.

Still another object of the invention is to provide a new portable outdoor table with a minimal number of parts that can be anchored to a surface so as to provide increased stability. How these and other objects are accomplished will become apparent from the following descriptions and from the drawings.

SUMMARY OF THE INVENTION

This invention involves a portable table that can be anchored to an earthen surface. The portable table has a top portion having a first side and a second side. At least one stand member is attached to the second side of the top portion.

BRIEF DESCRIPTION OF THE DRAWINGS

The qualities and advantages of the portable outdoor table disclosed in the present invention will be readily apparent if the following detailed description is read in conjunction with the accompanying drawings.

FIG. 1 is a perspective view of the portable outdoor table made in accordance with the present invention.

FIG. 2 is an exploded, perspective view of the portable table of FIG. 1.

FIG. 3. is an underneath perspective of the table in accordance with the present invention, illustrating the assembly of the table.

FIG. 4. is a side perspective of the table in accordance with the present invention, illustrating a telescoping stand member.

FIGS. 5 and 6. illustrate typical uses of certain embodiments of the present invention.

DETAILED DESCRIPTION OF THE PREFERRED EMBODIMENTS

As shown in FIGS. 1–5, the invention involves a portable table 10 which can be anchored to an earthen surface 12. The portable table 10 has a top portion 14 having a first side 16 and a second side 18. At least one stand member 20 is attached to the second side 18 of the top portion 14. Although the top portion 14 of the table 10 can take the form of any geometric shape including, in particular, a circular or oblong shape, the size of the top portion 14 should be such as to allow for ease of carrying. Therefore, the top portion 14 may be no greater than approximately 12 inches at its widest point, however, top portions 14 of greater or lesser dimensions could be used without departing from the spirit of the invention.

In one embodiment of the invention, as shown in FIGS. 1, 2, and 4, the at least one stand member 20 has a first end 22 and a second end 24 the first end 22 being attached to the top portion 14 and the second end 24 forming a spike. FIGS. 2 and 3 show another embodiment, where the portable table 10 includes a mounting piece 26 having a first side (not shown) and second side 28 where the first side of the mounting piece 26 is attached to the second side 18 of the top portion 14 and the first end 22 of the at least one stand member 20 is attached to the second side 18 of the top portion 14. The attachment of the first end 22 of the stand member 20 to the mounting piece 26 can be accomplished in various ways including, for example, screwing or snapping the first end 22 of the stand member 20 into the mounting piece 26.

In another embodiment of the invention, the first end 22 of the stand member 20 is removably attached to the second side 18 of the top portion 14 of the portable table 10. In a particular version of this embodiment, the first end 22 of the stand member 20 is capable of being screwed into and out of the second side 18 of the top portion 14.

In yet another embodiment of the invention, the stand member 20 may be comprised of at least two telescoping sections that are further secured to each other to form the stand member.

In yet another embodiment of the invention, the stand member sections are secured to one another using threaded inserts, interference fitting, or a pin through concentric holes formed in each stand member section. Other securing devices can be utilized as will be known to one of skill in the art upon understanding the invention.

In still another embodiment of the invention, a securing device 30 capable of storing the removed stand member 20 is attached to the second side 18 of the top portion 14. The securing device 30 which may be, among other things, a clamp or a combination clamp and screw, allows one to secure the stand member 20 to the top portion 14 when the table 10 is not in use, thereby making it easier to carry the entire table 10. The clamp may be adapted to secure various stand member configurations, for example telescoping members and the like.

In another embodiment of the invention, as shown in FIGS. 1, 2 and 4, the first end 22 of the stand member 20 has a first diameter and the second end 24 of the stand member 20 has a second diameter. The first diameter is greater than the second diameter as the stand member 20 is tapered from one end to the other. This allows the top portion 14 to have more stable support while, at the same time making it easier to anchor the stand member 20 into an earthen surface 12. In still another embodiment of the invention, as shown in FIG. 4, the stand member 20 is comprised of at least two sections 32, 34. In this embodiment, the first section 32 of the at least two sections 32, 34 includes an opening 35 having a first diameter, the second section 34 of the at least two sections 32, 34 has a second diameter, the first diameter is greater than the second diameter, and the second section 34 of the at least two sections 32, 34 fits within the opening 35 of the first section 32, thereby forming a telescoping stand member 20 that allows for the table height to be adjusted. The section members may be secured to each other using various securing devices such as threaded insert connectors; interference fit; or a pin through concentric openings formed in the each of the sections.

FIGS. 1, 2, 5 and 6 show another embodiment of the invention in which the top portion 14 of the portable table 10 is circumscribed by an edge portion 36 and the top portion includes an opening or a "cutout" 38 adjacent to the edge portion 36. This opening or cutout 38 can serve, among other things, as a handle or beverage holder.

The portable table 10 made be made of any suitable material, including wood, molded plastic, steel or other metal, without departing from the spirit of the invention.

When in operation, the user detaches the stand member 20 from the second side 18 of the top portion 14. The first end 22 of the stand member 20 is then attached either directly to the second side 18 of the top portion 14, or to the second side 28 of the mounting piece 26, if one is used. Should the stand member 20 be of the telescoping type or provided to be assembled in sections, the stand member 20 is adjusted to the desired height and the member 20 is secured through the use of a pin or the like (not shown).

Once the height of the stand member 20 has been adjusted, the user anchors the second end 24 of the stand member 20 into the ground by applying force to the first side 16 of the top portion 14. This application of force pushes the second end 24 of the stand member 20 into the earthen surface 12, thereby securing the table 10 in the ground 12.

While the principles of the invention have been shown and described in connection with but a few embodiments, it is understood clearly that such embodiments are by way of example and are not limiting.

The claimed invention is:

1. A portable table comprised of:

a top portion having a first side and a second side, the top portion circumscribed by an edge having opposing surfaces;

at least one stand member attached to the second side of the top portion, said stand member capable of being anchored to an earthen surface; and an opening through the top portion in communication with a slot that extends through the opposing surfaces of the edge.

2. The portable table of claim 1 wherein the at least one stand member has a first end and a second end, the first end is attached to the second side of the top portion; and the second end forms a spike.

3. The portable table of claim 1 further comprised of a mounting piece having a first side and a second side where the first side of the mounting piece is attached to the second side of the top portion and the second side of the mounting piece is removably attached to the first end of the stand member.

4. The portable table of claim 1 wherein the first end of the stand member is removably attached to the second side of the top portion.

5. The portable table of claim 1 further comprised of: a securing device attached to the second side of the top portion, said securing device capable of securing the stand member.

6. The portable table of claim 1 wherein the stand member is capable of being screwed into and out of the second side of the top portion.

7. The portable table of claim 1 wherein the first end of the stand member has a first diameter, the second end of the stand member has a second diameter and the first diameter is greater than the second diameter.

8. The portable table of claim 1 wherein the stand member is comprised of at least two sections.

9. The portable table of claim 8 wherein:

the first section of the at least two sections includes an opening having a first diameter;

the second section of the at least two sections has a second diameter;

the first diameter is greater than the second diameter, and the second section of the at least two sections fits within the opening of the first section, thereby forming a telescoping stand member.

10. The portable table of claim 8 wherein the at least two sections forming the stand member are secured to each other using a threaded connector or a pin inserted through concentric openings formed in each of the at least two sections.

11. The portable table of claim 1 wherein:

the top portion is oblong shaped; and the oblong shape measures no greater than approximately 12 inches at its widest point.

12. The portable table of claim 1 wherein the top portion and the stand member are made of wood.

13. The portable table of claim 1 wherein the top portion and the stand member are made of molded plastic.

14. The portable table of claim 1 wherein the top portion and the stand member are made of steel.

15. The portable table of claim 1, wherein the slot is capable of receiving a stemmed drinking container.

16. The portable table of claim 1 wherein the opening further comprises a ridge disposed on an inner surface of the opening.

17. The portable table of claim 1 further comprising a securing device attached to the second side of the top portion, said securing device capable of securing the stand member to the top portion.

* * * * *